US009301572B2

(12) United States Patent
Bier et al.

(10) Patent No.: US 9,301,572 B2
(45) Date of Patent: Apr. 5, 2016

(54) UPPER ARRANGEMENT FOR FOOTWEAR, AND FOOTWEAR WITH SAID UPPER ARRANGEMENT

(75) Inventors: Christian Bier, Miesbach (DE); Stane Nabernik, Kranj (SI); Thorger Hübner, Flintsbach (DE); Tore Strömfors, Lindome (SE); Jakob Møller Hansen, Aabenraa (DK); Frank Jensen, Bredebro (DK)

(73) Assignees: W. L. Gore & Associates GmbH, Putzbrunn (DE); W. L. Gore & Associates Scandinavia AB, Mölndal (SE); ECCO Sko A/S, Bredebro (DK)

( * ) Notice: Subject to any disclaimer, the term of this patent is extended or adjusted under 35 U.S.C. 154(b) by 343 days.

(21) Appl. No.: 13/820,049

(22) PCT Filed: Sep. 2, 2011

(86) PCT No.: PCT/EP2011/065191

§ 371 (c)(1),
(2), (4) Date: May 29, 2013

(87) PCT Pub. No.: WO2012/028714

PCT Pub. Date: Mar. 8, 2012

(65) Prior Publication Data

US 2013/0247414 A1 Sep. 26, 2013

(30) Foreign Application Priority Data

Sep. 3, 2010 (DE) ..... 10 2010 044 260

(51) Int. Cl.
*A43B 7/12* (2006.01)
*A43B 23/02* (2006.01)
*A43B 7/08* (2006.01)

(52) U.S. Cl.
CPC ..... *A43B 23/026* (2013.01); *A43B 7/08* (2013.01); *A43B 7/087* (2013.01); *A43B 7/088* (2013.01); *A43B 7/125* (2013.01); *A43B 23/022* (2013.01); *A43B 23/0235* (2013.01)

(58) Field of Classification Search
CPC ..... A43B 7/06; A43B 7/08; A43B 7/084; A43B 7/087; A43B 7/088; A43B 7/12; A43B 7/125; A43B 23/022; A43B 9/16; A43B 9/18
USPC ..... 36/3 R, 3 A, 3 B, 45, 30 R, 12
See application file for complete search history.

(56) References Cited

U.S. PATENT DOCUMENTS

| | | | |
|---|---|---|---|
| 3,953,566 | A | 4/1976 | Gore |
| 4,187,390 | A | 2/1980 | Gore |

(Continued)

FOREIGN PATENT DOCUMENTS

| | | | |
|---|---|---|---|
| CN | 101421453 | | 4/2009 |
| DE | 1034067 | | 12/1954 |
| DE | 20 2007 000 668 | | 5/2007 |
| DE | 10 2006 009 974 | | 9/2007 |
| DE | 10 2008 029 296 | | 12/2009 |
| JP | 2003-509146 | | 3/2003 |
| JP | 3109236 | | 3/2005 |
| JP | 2006-528010 | | 12/2006 |
| KR | 10-2009-0026799 | A | 3/2009 |
| WO | EP1135039 | | 3/2001 |
| WO | 2008/003375 | A1 | 1/2008 |
| WO | WO2009/149887 | | 12/2009 |
| WO | WO2009/153054 | | 12/2009 |
| WO | WO2010/072547 | | 7/2010 |
| WO | WO 2011/092172 | | 8/2011 |

*Primary Examiner* — Marie Bays

(74) *Attorney, Agent, or Firm* — Kilpatrick Townsend & Stockton LLC

(57) ABSTRACT

The invention relates to an upper arrangement (22) for footwear (2), comprising an upper region (23) with a water vapor-permeable upper material layer (24) that comprises a lower end section; a waterproof and water vapor-permeable upper functional layer laminate (26) that comprises a lower end section; and an upper base (34) with an upper base functional layer laminate (38) that has a lateral end section. The lower end section of the upper region (23) is connected to the lateral end section of the upper base (34); and the upper base functional layer laminate (38) is designed as a multilayer laminate that comprises a waterproof and water vapor-permeable functional layer (40) that lies bottommost and at least one water vapor-permeable textile layer (42) that lies over said functional layer.

14 Claims, 8 Drawing Sheets

(56) References Cited

U.S. PATENT DOCUMENTS

| | | | | |
|---|---|---|---|---|
| 4,194,041 | A | 3/1980 | Gore | |
| 4,493,870 | A | 1/1985 | Vrouenraets et al. | |
| 4,725,418 | A | 2/1988 | Friemel et al. | |
| 4,899,465 | A * | 2/1990 | Bleimhofer et al. | 36/14 |
| 5,689,903 | A * | 11/1997 | Aumann | 36/77 R |
| 7,559,157 | B2 | 7/2009 | Moretti | |
| 7,823,297 | B2 * | 11/2010 | Polegato Moretti | 36/3 R |
| 2004/0049942 | A1 | 3/2004 | Chen | |
| 2011/0167678 | A1 * | 7/2011 | Peikert | 36/3 R |
| 2011/0252667 | A1 * | 10/2011 | Polegato Moretti | 36/98 |
| 2012/0151806 | A1 * | 6/2012 | Polegato Moretti | 36/3 B |
| 2012/0311892 | A1 * | 12/2012 | Peikert | 36/30 R |
| 2013/0036631 | A1 * | 2/2013 | Nabernik | 36/103 |
| 2013/0055599 | A1 | 3/2013 | Peikert et al. | |
| 2013/0199060 | A1 | 8/2013 | Bier et al. | |
| 2013/0219755 | A1 * | 8/2013 | Polegato Moretti | 36/3 A |
| 2013/0239442 | A1 * | 9/2013 | Plegato Moretti | 36/3 A |

* cited by examiner

UPPER ARRANGEMENT FOR FOOTWEAR, AND FOOTWEAR WITH SAID UPPER ARRANGEMENT

The present invention concerns an upper assembly for footwear as well as footwear with such an upper assembly.

In the prior art, footwear is known that is equipped with a waterproof and breathable upper assembly, such that such footwear is able to release moisture caused by sweat to the outside, despite the waterproof nature in the upper portion.

With such footwear, the problem of moisture caused by sweat accumulating in the sole portion may then occur, which reduces the climatic comfort and may lead to damp feet in cold weather due to low temperature and wet conditions. The potential of moisture transfer away from this portion is limited in conventional breathable shoes.

In order for moisture caused by sweat to be able to escape also in the sole portion, soles were equipped with openings and the bottom portion of the upper assembly was equipped with a waterproof and breathable sole functional layer. A corresponding example, in which both the bottom portion as well as the remaining upper portion of the upper assembly are equipped with breathable, but waterproof functional layers, is known from DE 10 2008 029 296 A1. Bottom functional layers of this kind are provided with a lower textile layer.

It is a problem underlying the present invention to provide an alternative upper assembly for footwear as well as footwear therewith, in which a good evacuation of moisture, especially in the sole portion, is ensured in order to allow for a prevention of the occurrence of a wet and cold sensation at the foot, and in which the waterproof nature is maintained at the same time in order to enhance the climatic comfort.

This problem is solved by the subject-matter of the independent patent claims. Advantageous modifications are apparent from the dependent claims.

An inventive upper assembly for footwear comprises an upper portion with a breathable upper material layer, having a lower end area, and with a waterproof and breathable upper functional layer laminate, having a lower end area, and a bottom portion with a bottom functional layer laminate, having a side end area. The lower end area of the upper portion is connected to the side end area of the bottom portion, and the bottom functional layer laminate is a multiple layer laminate, which comprises a waterproof and breathable functional layer positioned bottommost and at least a breathable textile layer positioned thereabove. A waterproof and breathable functional layer positioned bottommost is understood herein as the outermost layer of the bottom portion or the outermost layer of the upper assembly facing the sole.

There are multiple constructive embodiments for the connection of the lower end area of the upper portion with the side end area of the bottom portion, as will be explained as follows.

The construction achieved by the connection of the upper functional layer laminate with the bottom functional layer laminate is waterproof around the entire foot, and is additionally breathable with the exception of the connection portion between the lower end area of the upper portion and the side end area of the bottom portion, where a seal is commonly provided. Such a seal may as an example be in the form of a sealing glue or a sealing tape or may be formed by sole material injected there.

The upper functional layer laminate may be connected with the upper material in a suitable manner in all embodiments, it may for example be sewn thereto at an upper side.

According to the invention, the bottom functional layer laminate is a multiple layer laminate and comprises a waterproof and breathable functional layer positioned bottommost.

Moisture caused by sweat or water vapor can be transported away from the inside of the upper assembly to the outside through the multiple layer bottom functional layer laminate, having the functional layer positioned bottommost, more easily than in the case of conventional upper assemblies.

An additional layer of the bottom functional layer laminate below the functional layer positioned bottommost is explicitly dispensed with. The water vapor escaping from the inside of the upper assembly does not have to pass an additional layer, and the barrier to be passed by the water vapor is reduced therewith and the breathability increased accordingly. Moreover, a soaking of the lower textile material is prevented, which often occurs in shoes with holes in the sole, through which water can penetrate, and with conventional bottom functional layer laminate. This results in the foot feeling less cold with the present invention. Long drying times of such a soaked lower textile material and long periods of cold feelings resulting therefrom are reliably prevented. Additionally, the bottom functional layer laminate of the inventive upper assembly is less susceptible to getting dirty, because dirt particles cannot penetrate into the waterproof and breathable functional layer positioned bottommost and can also not adhere thereto well. Many lower textile layers, which are conventionally used, are also pressed into the bottom functional layer due to their exemplarily grid-shaped structure. This can lead to a compacting of the functional layer at some spots and may therefore lead to this functional layer not being waterproof.

The inventors of the present subject-matter of the application have found out that such an additional outer layer of the bottom functional layer laminate may be dispensed with within the area of the bottom portion.

There may be positioned one or more layers, for example, two textile layers, above the bottom functional layer.

Conceptionally, the inventive upper assembly is not limited to particular constructional variants, but can be adopted in a plurality of arbitrary constructional variants.

According to a first embodiment of the invention, the multiple layer bottom functional layer laminate is a two layer laminate and accordingly comprises a bottom functional layer positioned bottommost and a supporting textile layer positioned thereabove. As compared to usual multiple layer bottom functional layer laminates, the barrier to be passed by the water vapor is effectively reduced by one layer by this two layer embodiment of the bottom functional layer laminate. Therefore, the amount of water vapor that can be transported from the interior of the shoe to the outside can be increased significantly, and the breathability of footwear with such an upper assembly is increased as compared to usual breathable footwear.

By saving at least one additional material layer, the corresponding production step during lamination is omitted, which also saves a production step in addition to the material savings. The shoe with such an upper assembly Ran therefore be produced more economically and more quickly and it is also lighter.

According to a further embodiment of the invention, the upper functional layer laminate of the remaining upper assembly may be a three layer laminate in a conventional manner. Of course, it is also possible to design this upper functional layer laminate with two layers as well, in order to increase the potential for transporting away water vapor in the side portions and on the upper side of the upper assembly as well.

According to a constructional variant of the inventive upper assembly, the lower end area of the upper portion, in particular of the breathable upper material layer, is designed such that it allows for a penetration of sealing material to the waterproof and breathable functional layer of the functional layer laminate of the upper portion and, where appropriate, also to the connection between the upper functional layer laminate and the bottom functional layer laminate. This constructional variant is particularly suitable for footwear with an at least partially injected sole unit. The injected sole material reaches, when being injected, the waterproof and breathable functional layer of the functional layer laminate of the upper portion, connects the sole unit with the upper portion in a reliable manner, and additionally seals the connecting portion between the lower end area of the upper portion and the side end area of the bottom portion in a waterproof manner. When using a sole with openings, the seam connecting the upper functional layer and the bottom functional layer is to be sealed.

In this constructional variant, a netband can be provided in addition, which connects the lower end area of the breathable upper material layer with the side end area of the bottom functional layer laminate. In this case, the lower end area of the upper functional layer laminate is commonly also connected to the bottom functional layer laminate. The netband allows for a penetration of an injected sole material up to the functional layer of the functional layer laminate of the upper portion and seals at the same time the connecting seam between netband, bottom functional layer laminate and upper functional layer laminate. The constructional variant with such a netband is particularly suitable for cases where the sole unit is at least partially injected on the upper assembly.

According to a further embodiment of the upper assembly, which is often also referred to as bootie, the lower end area of the functional layer laminate of the upper portion is sewn to the side end area of the bottom functional layer laminate, in particular with a strobel or zig zag seam.

The waterproof and breathable bottom functional layer, which is the bottommost layer of the bottom functional layer laminate, may be provided with supporting members, in particular with dots, at its underside. The dots ensure that the bottom functional layer itself does not come to lie directly on the portion of the sole unit arranged therebelow, but that the dots come to lie thereon and keep a distance between the bottom functional layer and the portion of the sole unit arranged therebelow. The dots enhance the grip between the bottom functional layer laminate and the sole unit. Additionally, the dots may be embodied in such a way that they form a particular pattern or grid that is matched on the sole side and prevents the layer from being displaced during use. The dots may also be shaped and distributed over the underside of the bottom functional layer in an arbitrary fashion. Moreover, the dots may compensate for a potentially uneven surface of the sole unit or they may prevent a pressing of the functional layer along edges/recesses, such that the wearer's comfort is enhanced. In the cases where the sole unit comprises a ventilation channel structure, a suitable arrangement of the dots prevents a forcing of the bottom functional layer into the channels of the channel structure of the sole unit. Moreover, the dots and the channel structure arranged therebelow may form a functional unit in such a way that the arrangement of the dots assists in the air exchange in the channel structure below the dots.

The dots may be embodied in the form of a plurality of discrete abrasion-resisting polymeric dots on the bottom functional layer, forming a discontinuous pattern and a discontinuous lining.

In a particular embodiment, the polymeric dots have a smooth, rounded, non-angular external surface. They may be substantially circular in plan view and part-spherical in cross-section. Such a design of the dots contributes to providing a smooth and comfortable feel of the shoe to the wearer of the shoe. The dots may be arranged in a repeat regular pattern, such as in a plurality of parallel rows, or in a random pattern.

In a particular embodiment, the polymeric dots cover 20-80% of the area of the bottom functional layer laminate, preferably 30-70% and even more preferably 40-60%. In a further embodiment, each dot is preferably of a maximum cross-dimension or width in the plane of the bottom functional layer which is less than 5000 microns, for example in the range of 100 to 1000 microns, preferably 200-800, an even more preferably 400-600 microns. The dots may be spaced apart, centre-to-centre, by 200-2000 microns, preferably 300-1500, and even more preferably 400-900 microns. Each dot may have a height in the range of 10-200 microns, preferably 70-140, and even more preferably 80-100 microns.

The invention also concerns footwear with at least an upper assembly of the kind described above and with a sole unit that is provided with at least one ventilation passage opening or designed in such a porous way that allows for an air exchange with the environment. The sole unit may be connected to the upper assembly in an arbitrary manner, in particular at least a part of the sole unit is attached to the underside of the upper assembly. Additionally, the side end area of the bottom functional layer laminate and the lower end area of the functional layer laminate of the upper portion are bonded together, and a waterproof seal is provided at the bond.

The advantages and embodiments mentioned above with respect to the upper assembly equally apply to the inventive footwear. They are therefore not repeated.

In a first embodiment of the inventive footwear, at least a part of the sole unit is injected on the underside of the upper assembly. Therein, the injected sole material reaches advantageously up to the waterproof and breathable functional layer of the upper laminate and of the bottom laminate in the end area of the upper portion, and the waterproof seal between the side end area of the bottom functional layer laminate and the lower end area of the upper functional layer laminate may be formed by this injected sole material.

According to a further embodiment of the inventive footwear, at least a part of the sole unit is glued to the underside of the upper assembly. In this embodiment, the waterproof seal of the bond between the side end area of the bottom functional layer laminate and the lower end area of the functional layer laminate of the upper portion may preferably be effected by a sealing glue placed there.

According to a further embodiment of the inventive footwear, at least a part of the sole unit is sewn to the underside of the upper assembly. Therein, the seam is also suitable for sealing in order to allow for the waterproof nature of the footwear.

In all constructional variants mentioned above, water vapor or moisture caused by sweat is transported away from the interior of the upper assembly mainly through the inventive bottom functional layer laminate downwards and is therefore released to the shoe exterior. For this purpose, at least one ventilation passage opening may be provided in the sole unit, which leads from the upper side to the underside of the sole unit or from the upper side of the sole unit to its side. Alternatively, the sole unit may also comprise porous, in particular breathable material, such as a porous synthetic material or leather.

Definitions and Testing Methods

Footwear:

Footgear/Footwear with a closed upper part (upper assembly), which comprises an opening for inserting a foot, and at least a sole or a sole unit.

Upper Material:

A material forming the outer side of the upper portion and therewith of the upper assembly, which exemplarily consists of leather, a textile, a synthetic material or other known materials or combinations thereof or which is constructed thereof and which generally consists of breathable material. The sole-side lower end of the upper material forms a portion adjacent to the upper edge of the sole or of the sole unit or a portion above a boundary plane between upper portion and sole or sole unit.

Assembly Sole (Insole):

An assembly sole is part of the bottom portion of the upper assembly. A sole-side lower end region of the upper portion is attached to the assembly sole.

Sole:

A shoe has at least an outer sole, but may also have multiple kinds of sole layers, which are arranged on above the other and form a sole unit.

Outer Sole:

An outer sole is understood to be that part of the sole portion that touches the floor/ground or that provides for the main contact to the floor/ground. The outer sole comprises at least an outer surface touching the floor.

Intermediate Sole:

In the case that the outer sole is not directly attached to the upper assembly, an intermediate sole may be inserted between the outer sole and the upper assembly. The intermediate sole may as an example serve to as padding, cushioning or as filler material.

Bootie:

A sock-like inner lining of an upper assembly is referred to as bootie. A bootie forms a pocket-like lining of the upper assembly, which covers the interior of the footwear substantially completely.

Functional Layer:

Waterproof and/or breathable layer, for example in the form of a membrane or a correspondingly treated or finished material, for example a textile with plasma treatment. The functional layer may form at least one layer of a bottom portion of the upper assembly in the form of a bottom functional layer, but may also additionally be provided as an upper functional layer lining the upper portion at least partially. Both the bottom functional layer and the upper functional layer can be parts of a multiple layer, generally a two-, three- or four-layer membrane laminate. The upper functional layer and the bottom functional layer may be respective parts of a functional layer bootie. If an upper functional layer and a separate bottom functional layer are used instead of the functional layer bootie, they are sealed in a waterproof manner with respect to each other, for example in the sole-side lower portion of the upper assembly. Bootie parts are mostly sealed with respect to each other in a waterproof manner at an earlier stage, in particular with a waterproof seam tape. Bottom functional layer and upper functional layer may be from different materials or the same material.

Appropriate materials for the waterproof, water-vapor-permeable functional layer are especially polyurethane, polypropylene, and polyesters, including polyether esters and laminates thereof, as described in documents U.S. Pat. Nos. 4,725,418 and 4,493,870. In one variant, the functional layer is constructed with microporous, expanded polytetrafluoroethylene (ePTFE), as described for example in documents U.S. Pat. Nos. 3,953,566 and 4,187,390. In an embodiment, the functional layer is made from expanded polytetrafluoroethylene provided with hydrophilic impregnation agents and/or hydrophilic layers; see, for example, document U.S. Pat. No. 4,194,041. Microporous functional layers are understood to mean functional layers whose average pore size is between approximately 0.1 and approximately 2 μm.

Laminate:

A laminate is a composite consisting of several layers permanently joined together, generally by mutual gluing. In a functional-layer laminate, a waterproof, breathable functional layer is provided with at least one textile layer. The at least one textile layer may mainly serve to protect the functional layer during manufacture. Here, we speak of a two-layer laminate. A three-layer laminate consists of a waterproof, breathable functional layer embedded in two textile layers. Such textile layers may be designed as woven, warp-knitted, knitted or non-woven textile layers made from natural or synthetic fibers. Particularly suitable synthetic fibers are PP, PA and PES. Non-wovens from synthetic fibers with more or less close fibers distances are often referred to as mesh. The connection between the functional layer and the at least one textile layer occurs, as an example, by means of a continuous breathable glue layer or by a discontinuous glue layer from non-breathable glue. In one embodiment, a glue can be applied in the form of a spot-wise pattern between the functional layer and the one or both textile layers. Spot-wise or discontinuous application of glue occurs, because a full-surface layer of a glue that is not breathable itself would block the breathability of the functional layer.

Barrier Layer:

A barrier layer serves as a barrier against the penetration of substances, in particular in the form of particles or foreign objects, such as small rocks/stones, to a material layer to be protected, in particular to a mechanically sensitive functional layer or functional layer membrane.

Waterproof:

A functional layer/functional-layer laminate/membrane is considered "waterproof," optionally including the seams provided on the functional layer/functional-layer laminate/membrane, if it guarantees a water-entry pressure of at least $1\times10^4$ Pa. The functional-layer material preferably withstands a water-entry pressure of more than $1\times10^5$ Pa. The water-entry pressure is then measured according to a test method, in which distilled water at 20±2° C. is applied to a sample of 100 $cm^2$ of the functional layer with increasing pressure. The pressure increase of the water is 60±3 cm $H_2O$ per minute. The water-entry pressure then corresponds to the pressure at which water first appears on the other side of the sample. Details concerning the procedure are stipulated in ISO standard 0811 from the year 1981.

Whether a shoe is waterproof can be tested, for example, with a centrifuge arrangement of the type described in U.S. Pat. No. 5,329,807.

Breathable:

A functional layer/functional-layer laminate is considered "breathable"/"water-vapor permeable" if it has a breathability/water-vapor-permeability number Ret of less than 150 $m^2\times Pa\times W^{-1}$. Water-vapor permeability is tested according to the Hohenstein skin model. This test method is described in DIN EN 31092 (February 1994) and ISO 11092 (1993).

The invention is subsequently described in more detail with the help of exemplary embodiments and with respect to the enclosed figures.

All subsequent representations are schematic and are not true to scale.

Figure 1:
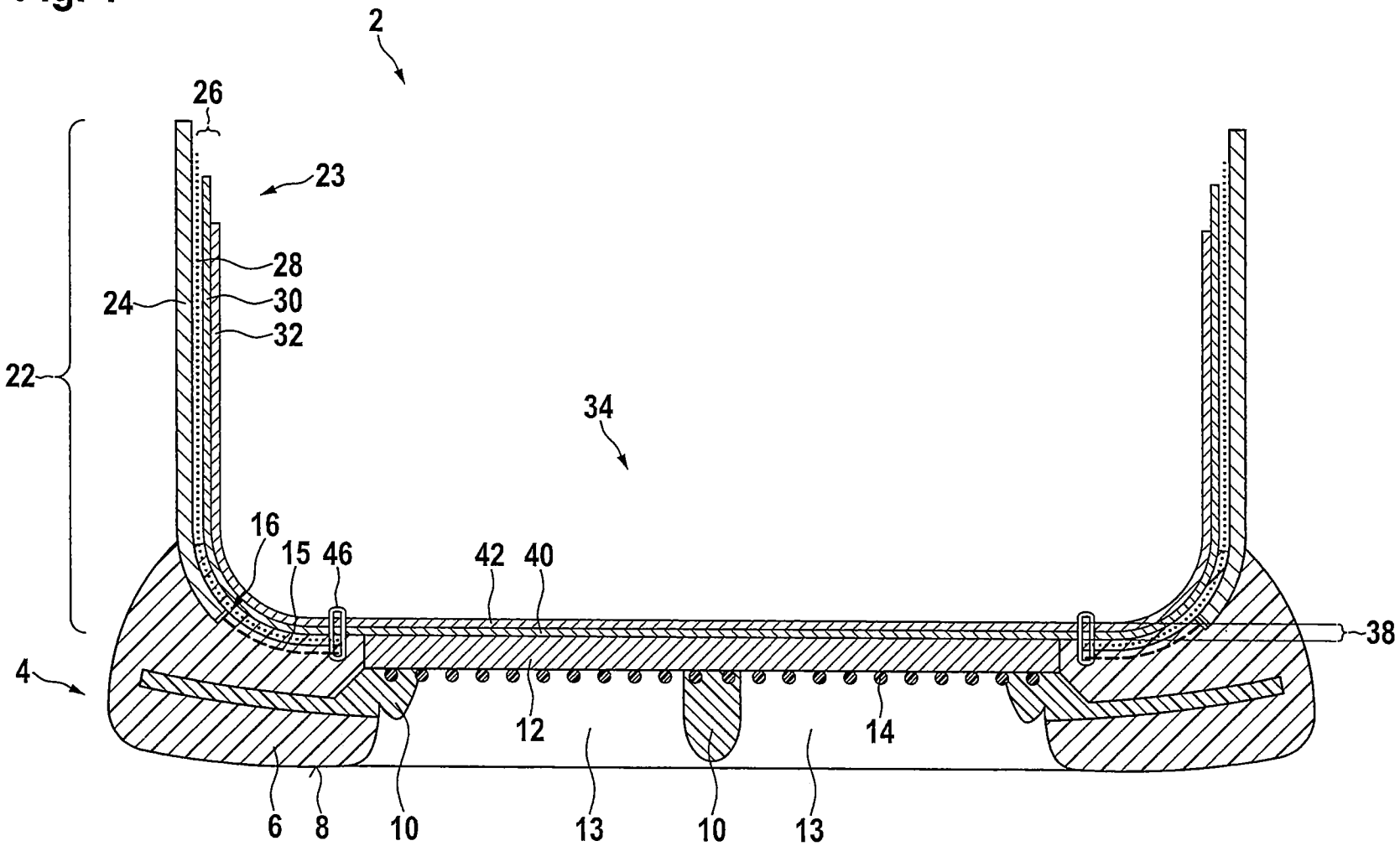
FIG. 1 shows a cross-sectional view of a forefoot portion of a first shoe in accordance with a first exemplary embodiment of the invention.

FIG. 1 shows a cross-sectional view of a forefoot portion of a first shoe 2 in accordance with a first exemplary embodiment of the invention.

The first shoe 2 comprises an upper assembly 22 with a sole unit 4 injected thereon from below.

The upper assembly 22 comprises a bottom portion 34 and an upper portion 23 connected with the bottom portion 34 along its parameter. A left section and a right section of the upper portion are shown in FIG. 1, which are mirror images of each other. The upper section of the upper portion 23 is for simplicity neither shown in this figure nor in the subsequent figures.

The upper portion 23 comprises a breathable upper material layer 24 and an upper functional layer laminate 26, which comprises—from the outside to the inside—a first textile layer 28, such as a thin permeable meshed material, an upper functional layer/upper membrane 30 and a second textile layer in the form of an upper lining 32.

The bottom portion 34, which is two-layered in the present exemplary embodiment, comprises—from top to bottom—a supporting textile layer 42 and a bottom functional layer 40, which forms the bottommost layer of the bottom portion 34. The supporting textile layer 42 and the bottom functional layer 40 together form the bottom functional layer laminate 38. The breathable textile layer 42 may therein be a so-called Cambrelle or a non-woven material, which provides a particularly good protection against abrasion by the foot.

The sole-side lower end area of the upper functional layer laminate 26 is folded to the inside and is connected at its lateral perimetric edge with the side end area of the bottom functional layer laminate 38 by a seam 46, for example a strobel seam or a zigzag seam.

The upper material layer 24 ends somewhat before this seam 46. A netband 15 is provided as extension of the upper material layer 24. This netband 15 is on the side of the upper material layer connected with the lower parametric edge of the upper material layer 24 via a seam 16, and it is connected at its other end with the lateral perimetric edge of the bottom functional layer laminate 38, also via the seam 46. The netband 15 as well as the first textile layer 28 of the upper functional layer laminate allow for a penetration of an injected sole material up to the upper functional layer 28 of the upper functional layer laminate 26, up to the seam 46 and up to the bottom functional layer 40.

The upper portion 23 and the bottom portion 34 are sewn together in the upper assembly 22.

The sole unit 4 comprises a supporting sole 10 and passage openings 13 reaching from top to bottom. Of the supporting sole 10, a middle supporting bar 10 and two outer side portions protruding outwardly are shown in FIG. 1. Moreover, the sole unit comprises a breathable barrier layer 12 positioned above the supporting sole 10 and an optionally provided decor layer 14 positioned therebelow. The barrier layer 12 and the decor layer 14 have a lateral extension that is somewhat smaller than the lateral extension of the bottom functional laminate layer 38 positioned thereabove, such that the barrier layer 12 and the decor layer 14 are not positioned underneath the seam 46, but are somewhat offset to the inside with respect to the seam 46.

Finally, the sole unit 4 also comprises the outer portions 6 made from injected sole material, in which the side portions of the supporting sole 10 are anchored, whose undersides form the outer surface 8 and which fix the upper portion 23 in position with respect to the sole unit 4 with their upper portions.

The supporting sole 10 with barrier layer 12 and with décor layer 14 is pre-assembled as a unit and is integrated into the sole unit via suitable injection tools during injecting of the outer portions 6 on the upper portion 23. In this process, the barrier layer 12 is positioned below the bottom functional layer. In this process, the injected sole material 6 penetrates the netband 15, the first textile layer 28 and the seam 46, reaches up to the lower end area of the upper functional layer 28 and up to the side end area of the bottom functional layer 40 and also penetrates somewhat into the portion behind the upper material layer 24, as can be seen well in FIG. 1. Also, the injected sole material 6 seals the seam 46 in a waterproof manner. The shoe 2 is therefore waterproof all around.

Also, the shoe 2 is breathable all around with the exception of the lower end area of the upper functional layer 26 and the side end area of the bottom functional layer 38, up to which the injected sole material 6 extends. The water vapor created in the interior of the upper portion is emitted laterally through the upper functional layer laminate 26 and the upper material layer 24 to the outside of the shoe as well as towards the bottom through the bottom functional layer 38, the barrier layer 12, the décor layer 14 and the passage openings 13 of the sole unit 4 to the outside of the shoe.

A space between the underside of the bottom functional layer 40 and the upper side of the barrier layer 12 is shown in FIG. 1, which does not have to be present. As an example, a further breathable layer, such as a comfort layer, may be provided in this space. Damaging of the bottom functional layer 40 during use can be prevented by designing the comfort layer from flexible and soft material. Also, the space may be dispensed with by positioning the barrier layer 12 of the supporting sole immediately below the bottom functional layer 40.

By omitting of an additional layer underneath the bottom functional layer as part of the bottom functional layer laminate, the barrier that the water vapor has to pass towards the bottom is reduced, and the water vapor that can be emitted from the interior of the shoe towards the bottom to the outside can be increased, which improves the breathability of the shoe 2.

Figure 2:
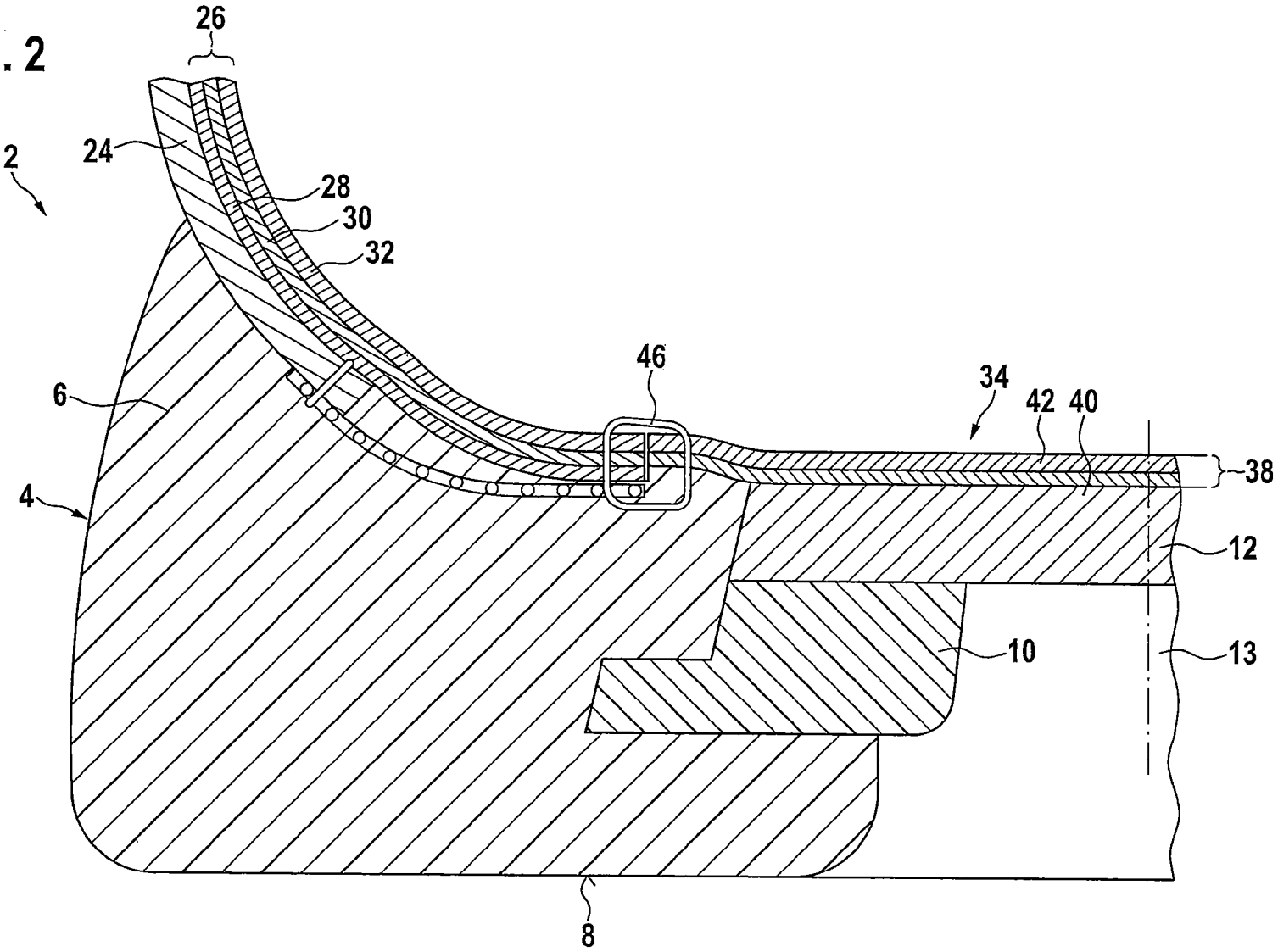
FIG. 2 shows an enlarged section of the left lower portion of the shoe of FIG. 1.

FIG. 2 shows an enlarged section of the left lower portion of the shoe 2 of FIG. 1.

The netband 15 is sewn to the outer side of the lower end area of the upper material layer 24 in the schematic view of FIG. 1. In practice, the netband 15 is in most cases sewn to the upper material 24 on the outside or on the inside, which effects a better positioning and a durable attachment. The bottom functional layer 40 of the bottom functional layer laminate 38 lies directly on the upper side of the barrier layer 12 with its underside, with a space being prevented here. Also, the constructive design and lateral extension of the supporting sole 10 is somewhat different from FIG. 1, and a décor layer, which is optional in any case, is not provided in the shoe 2 shown in FIG. 2.

Figure 3:
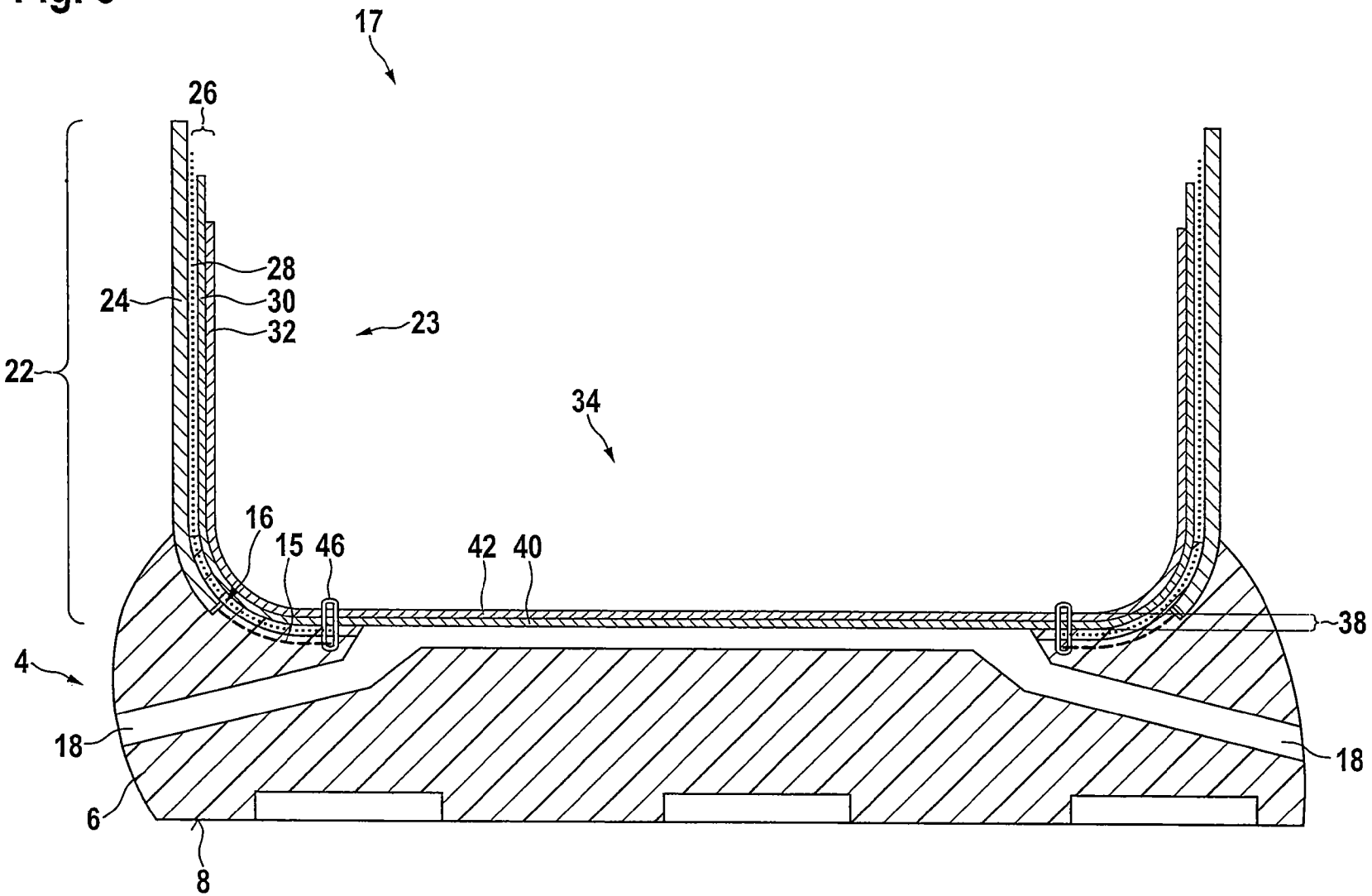
FIG. 3 shows a cross-sectional view of a forefoot portion of a second shoe in accordance with a second exemplary embodiment of the invention.

FIG. 3 shows a cross-sectional view of a forefoot portion of a second shoe 17 in accordance with a second exemplary embodiment of the invention.

The upper assembly 22 of the second shoe 17 corresponds to the upper assembly 22 of the first shoe 2. Like elements are provided with like reference numerals.

A sole unit 4 is also injected at the bottom of the upper assembly 23 in the second shoe 17. As compared to the sole unit 4 of the first shoe 2, passages/passage openings 18 are provided in the sole unit 4 of the second shoe 17, which passages lead from the portion of the upper side of the injected sole 6, which faces the bottom functional layer 40, to sidewalls of the sole 6. In this way, they carry the water vapor that is emitted from the interior of the upper assembly 22 via the multiple layer bottom portion 34 towards the outside of the upper assembly 22 to a zone laterally outside of the sole unit 4.

For simplicity, the sole unit 4 is illustrated in FIG. 3 in such a way that it only comprises the injected sole 6 with passage openings/passages 18 positioned therein. Of course, the sole unit 4, which has passage openings/passages leading to the side, may also comprise additional elements and layers, such as a supporting sole or a comfort layer or textile layer positioned on the upper side below the multiple layer bottom portion 34.

In FIG. 3, there is shown a space between the underside of the bottom functional layer 40 and the upper side of the injected sole material 6. This space serves to circulate moisture caused by sweat/water vapor from the interior of the upper assembly towards the outside. In order to prevent damaging of the bottom functional layer during wear of the shoe, at least a breathable barrier layer may as an example be placed in the space, or the material of the upper side of the sole unit 4, which is the material of the upper side of the injected sole 6 in the present exemplary embodiment, may chosen to be suitably soft and flexible.

Figure 4:
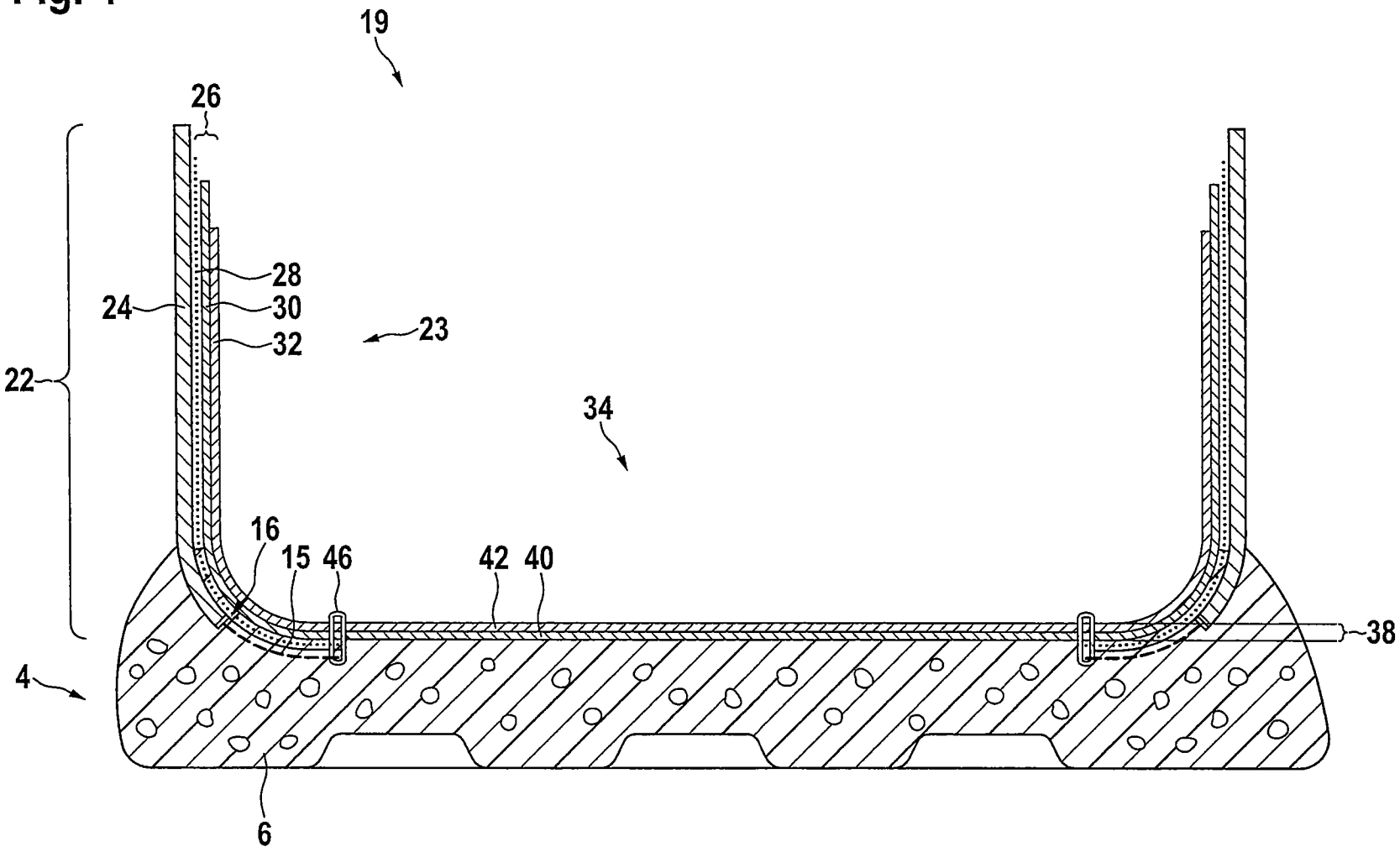
FIG. 4 shows a cross-sectional view of a forefoot portion of a third shoe in accordance with a third exemplary embodiment of the invention.

FIG. 4 shows a cross-sectional view of a forefoot portion of a third shoe 19 in accordance with a third exemplary embodiment of the invention.

The upper assembly 23 of the third shoe 19 corresponds to the upper assembly 23 of the first shoe 2. Like elements are provided with like reference numerals.

A sole unit 4 is injected to the bottom of the upper assembly 23 in the third shoe 19 as well. No passage openings/passages are provided in the sole unit 4 in FIG. 4. In contrast, the material of the sole unit 4 is porous and at least breathable and, where appropriate, also air permeable, as is exemplarily the case with porous synthetic materials, such that the water vapor is emitted from the interior of the upper assembly 22 through the multiple layer bottom portion 34 and through the porous sole material 6 to the outside of the shoe, both to the bottom as well as towards the side.

In the present exemplary embodiment, the injected sole material 6 of the sole unit 4 also extends through the netband 15, the seam 46 and the lower portion of the first textile layer 28 up to the lower end area of the upper functional layer 30 of the upper functional layer laminate 26 and up to the side end area of the bottom functional layer 40, and the injected sole material of the sole unit 4 seals the seam 46 in a reliable manner.

Figure 5:
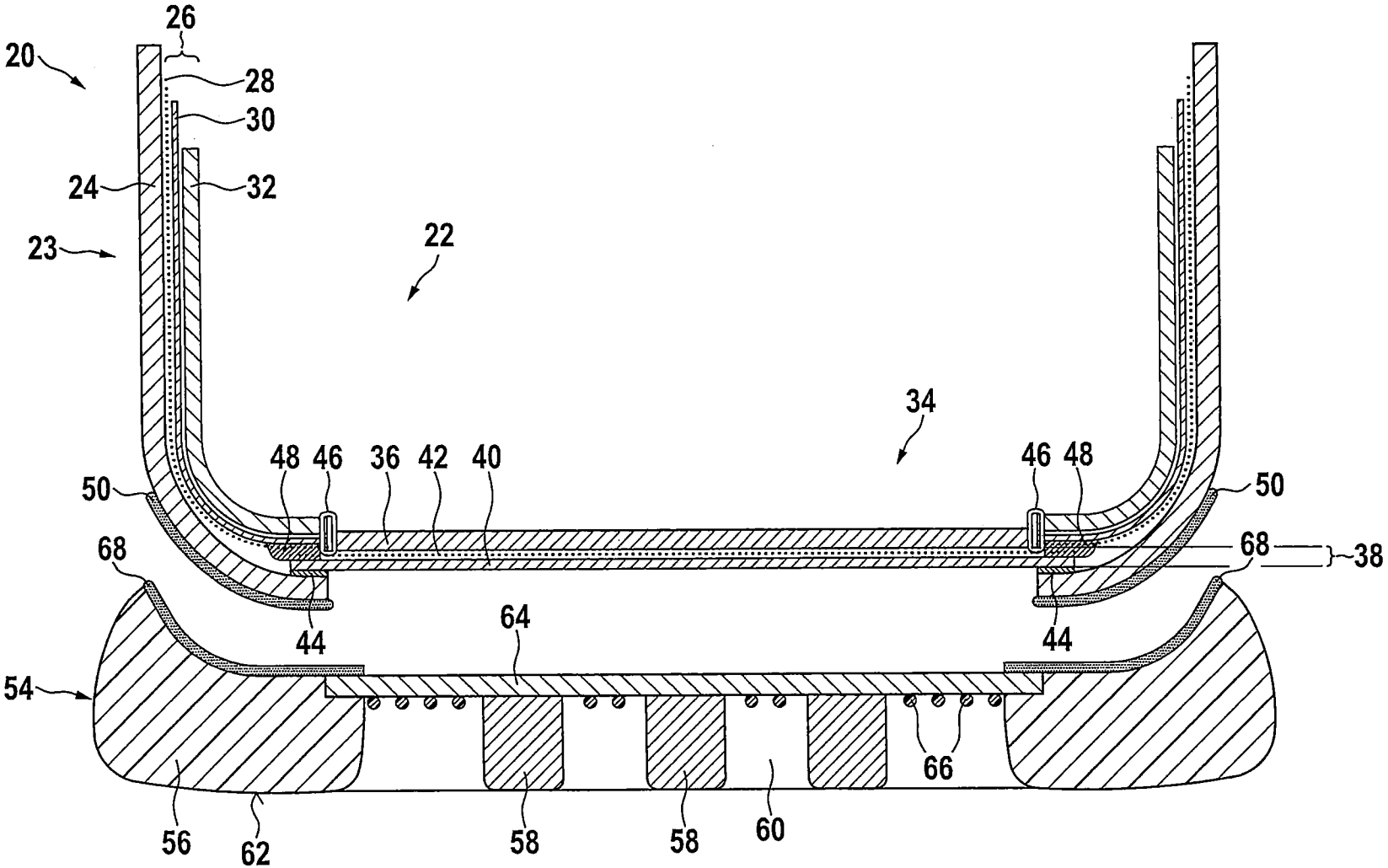
FIG. 5 shows a cross-sectional view of a forefoot portion of a fourth shoe in accordance with a fourth exemplary embodiment of the invention.

FIG. 5 shows a cross-sectional view of a forefoot portion of a fourth shoe 20 in accordance with a fourth exemplary embodiment of the invention.

The fourth shoe 20 is different from the shoes described above, in that it is a shoe with a glued sole.

Figure 6:
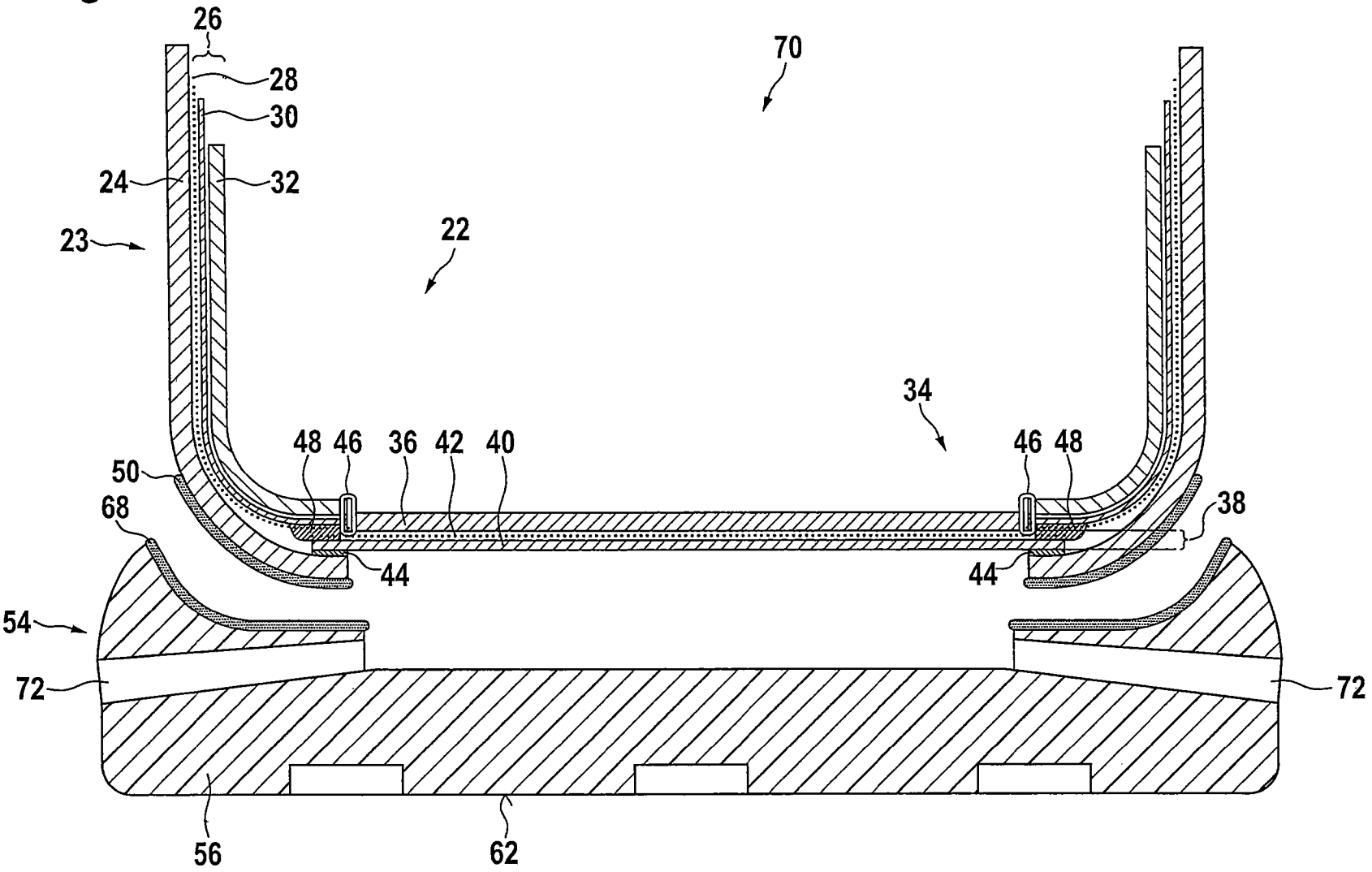
FIG. 6 shows a cross-sectional view of a forefoot portion of a fifth shoe in accordance with a fifth exemplary embodiment of the invention.

The sole unit 54 and the upper assembly 22 are not yet connected to each other in the illustration in accordance with FIG. 5 and the subsequent FIG. 6.

The upper assembly 22 comprises a bottom portion 34 and an upper portion 23 connected with the bottom portion 34 at its perimetric edge. A left section and a right section of the upper portion 23 are shown in FIG. 5, which are mirror images of each other. The upper section of the upper portion 23 is not shown in this as well as the subsequent figures for simplicity.

As in the preceding Figures, the upper portion 23 comprises a breathable upper material layer 24 and an upper functional layer laminate 26, which comprises—from the outside to the inside—a first textile layer 28, such as a thin permeable meshed material, an upper functional layer/upper membrane 30 and a second textile layer, such as an upper lining 32.

The multiple layer bottom portion 34 comprises—from top to bottom—an assembly sole/insole 36 and a bottom functional layer laminate 38 positioned therebelow, the bottom functional layer laminate 38 having a breathable textile layer 42 and a bottom functional layer 40 positioned bottommost. The breathable textile layer 42 has an open, penetratable meshed structure, in order to provide for a waterproof bond between the two functional layers. The assembly sole 36 is connected as its perimetric edge to the sole-side end area of the upper functional layer laminate 38 via a seam 46, such as a strobel seam or a zigzag seam.

The bottom functional layer laminate 38 is thus designed as a two layer laminate. As can be seen well in FIG. 5, the bottom functional layer laminate 38 has a larger lateral extension than the assembly sole 36 in order to connect the same with the sole-side end area of the functional layer laminate 26 and with the upper material layer 24 in a waterproof manner, for example via gluing with a sealing glue 48, which penetrates through the first textile layer 28 and the breathable textile layer 42 and forms a waterproof bond between the two functional layers 30, 40.

The sole-side lower end area of the upper material layer 24 is folded to the inside with respect to the section extending substantially vertically and is attached to the multiple layer bottom portion 34 via a lasting glue 44. Therein, the sole-side lower end area of the upper material layer 24 is attached with its upper side to the underside of the perimetric edge of the bottom functional layer laminate 38 via a lasting glue 44.

The sole-side lower end area of the upper functional layer laminate 26 is separate from the sole-side lower end area of the upper material layer 24, which leads to a gap in the end area of the upper portion 23 between the upper functional layer laminate 26 and the upper material layer 24, which becomes broader towards the end area of the upper portion 23. The bottom functional layer laminate 38 extends somewhat into this gap.

Moreover, the underside of the sole-side end area of the upper functional layer laminate 26 is connected with the upper side of the perimetric edge of the bottom functional layer laminate 38 via a sealing glue 48 in a waterproof manner, including the seam 46, which results in an all around waterproof and all around breathable upper assembly, if functional layers 26, 38 are used that are not only waterproof, but also breathable.

This sealing glue 48 penetrates through the first textile layer 28 and the supporting textile layer 42, thus sealing both functional layers with respect to each other, and serves to attach and to seal the bottom functional layer laminate 38 to the upper functional layer laminate 26, such that no additional glue is required for that purpose.

The sole unit 54 is pre-manufactured and attached to the sole-side lower end area of the upper material layer 24 via a sole glue, which has been applied at least to the upper side of the perimetric edge zone of the sole unit 4. In the present exemplary embodiment, a first sole glue layer 68 is applied to the upper side of the perimetric edge zone of the sole unit 54 and a second sole glue layer 50 is applied to the sole-side lower end area of the upper material layer 24.

The sole unit 54 comprises a sole layer 56 forming the circumferential outer portion thereof, which sole layer is shaped on its upper side somewhat in an upper direction in order to receive the bent portion of the upper material layer 24 and which sole layer comprises at least an opening in the middle, in which opening there are positioned—from bottom to top—at least a layer of supporting bars 58, a décor layer 66 and a barrier layer 64.

The glue layer 68 extends over the upper side of the sole layer 56, as can be seen well in FIG. 5. The portion of the barrier layer 64 positioned below the bottom functional layer 40 is provided predominantly without glue layer 68.

Three supporting bars of the supporting bar layer 58 are shown in FIG. 5. The lower surface of the sole layer 56 and of the supporting bar layer 58 is designed as outer surface/tread surface 62. Recesses/sole layer passage openings 60 are formed between the supporting bars of the supporting bar layer 58, in order to effect a breathability and, where appropriate, also an air permeability of the sole layer 56 with supporting bars 58.

The sole layer 56 can be one piece, as shown in the Figure, or be of several pieces, such as pieces in different colors.

The sole layer passage openings 60 are as large as possible in order to achieve a correspondingly high breathability of the sole layer 56 with supporting bars 58 and thus of the sole unit 54.

A barrier layer 64 is positioned horizontally across the sole unit 54 as mechanical protection for the bottom functional layer laminate 38 against damaging by foreign objects, for example small stones/rocks, which reach into the sole layer passage opening 60. This barrier layer 64 extends somewhat into the sole layer 56 and is thus anchored therein and connected therewith in a durable manner. This barrier layer 64 is formed with a thermally bonded fiber material in an embodiment, such that it additionally stabilizes the sole unit 54.

The supporting bar layer 58 can be produced from a material different from the sole layer 56, as is indicated by the different hatching, in order to achieve a weight reduction of the sole unit 54 or an improved walking comfort with respect to the step cushioning or both. Alternatively, the supporting bar layer 58 and the sole layer 56 may also be produced from the same material.

In particular, a material may be chosen for the supporting bar layer 58 that is softer than the material of the sole layer 56. If a good step cushioning is to be achieved, EVA is an example of a suitable material for the supporting bar layer 58. If a weight reduction as compared to the sole layer material is to be achieved, an expanded synthetic material with accordingly low specific weight is suitable. If both an improved step cushioning as well as a weight reduction with respect to the sole layer material are to be achieved, expanded EVA is a suitable example. However, there are many more material variants that can be used.

An optional décor layer 18 is positioned below the barrier layer 64. The décor layer 18 is visible from below and effects an attractive design of the sole unit.

When the fourth shoe 20 is worn, the bottom portion 34 is lying with the underside of its bottom functional layer 40 on the upper side of the barrier layer 64. In order to prevent damaging of the bottom functional layer 40, the barrier layer 64 is to be designed in an accordingly flexible and soft manner.

FIG. 6 shows a cross-sectional view of a forefoot portion of a fifth shoe 70 in accordance with a fifth exemplary embodiment of the invention.

The fifth shoe 70 is a shoe with glued sole like the fourth shoe 20. The upper assembly 22 and the attachment of the upper assembly 22 with respect to the sole unit 54 of the fifth shoe 70 correspond to the fourth shoe 20. Like elements are denoted with like reference numerals.

In contrast to FIG. 5, the sole unit 54 of FIG. 6 is equipped with passage openings/passages 72, which lead from the upper side of the middle portion of the sole unit 54 to its sides and thus allow for the transport of water vapor from the interior of the upper assembly 22 through the multiple layer bottom portion 34 and through the passage openings 72 to a zone laterally outside of the sole unit 54.

The sole unit 54 is a pre-manufactured sole layer element. Of course, additional sole elements and sole layers may also be provided in this embodiment, such as a supporting sole and/or a comfort layer and/or a barrier layer.

Figure 7:
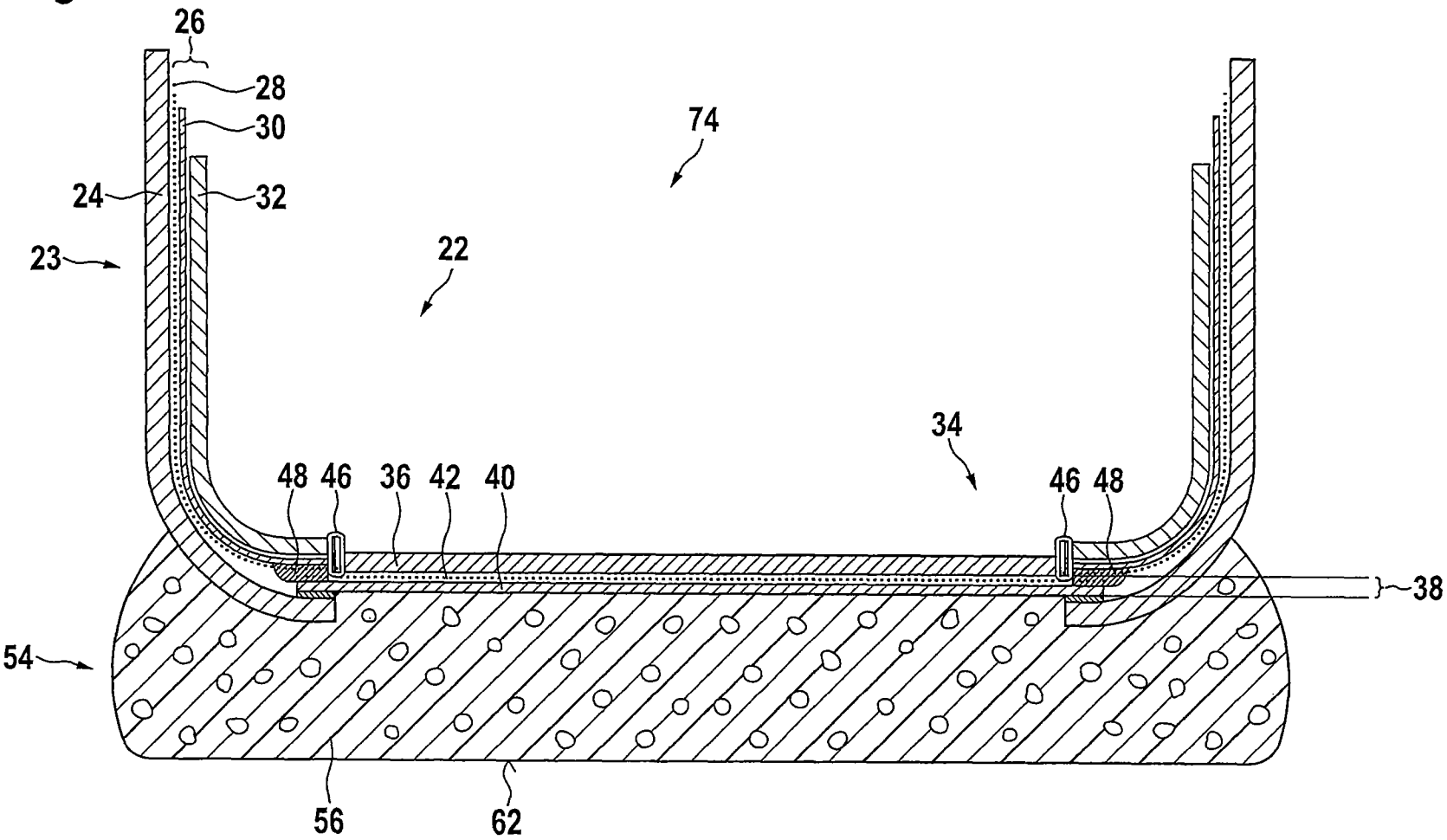
FIG. 7 shows a cross-sectional view of a forefoot portion of a sixth shoe in accordance with a sixth exemplary embodiment of the invention.

FIG. 7 shows a cross-sectional view of a forefoot portion of a sixth shoe 74 in accordance with a sixth exemplary embodiment of the invention.

The upper assembly 22 and the attachment of the upper assembly 22 with respect to the sole unit 54 of the sixth shoe 74 correspond to the fourth shoe 20. However, the sole is injected. Like elements are denoted with like reference numerals.

In the middle portion of the upper side of the sole unit 54, the underside of the bottom functional layer 40 lies on the upper side of the sole layer 56 of the sole unit 54.

No passage openings/passages are provided in the sole unit 54 of FIG. 7. In contrast, the material of the sole unit 54 is porous, at least breathable and, where appropriate, also air permeable, as is exemplarily the case with porous synthetic materials, such that the water vapor is emitted from the interior of the upper assembly 22 through the multiple layer bottom portion 34 and through the porous sole material 56 to the outside of the shoe, both towards the bottom as well as to the side.

Figure 8:
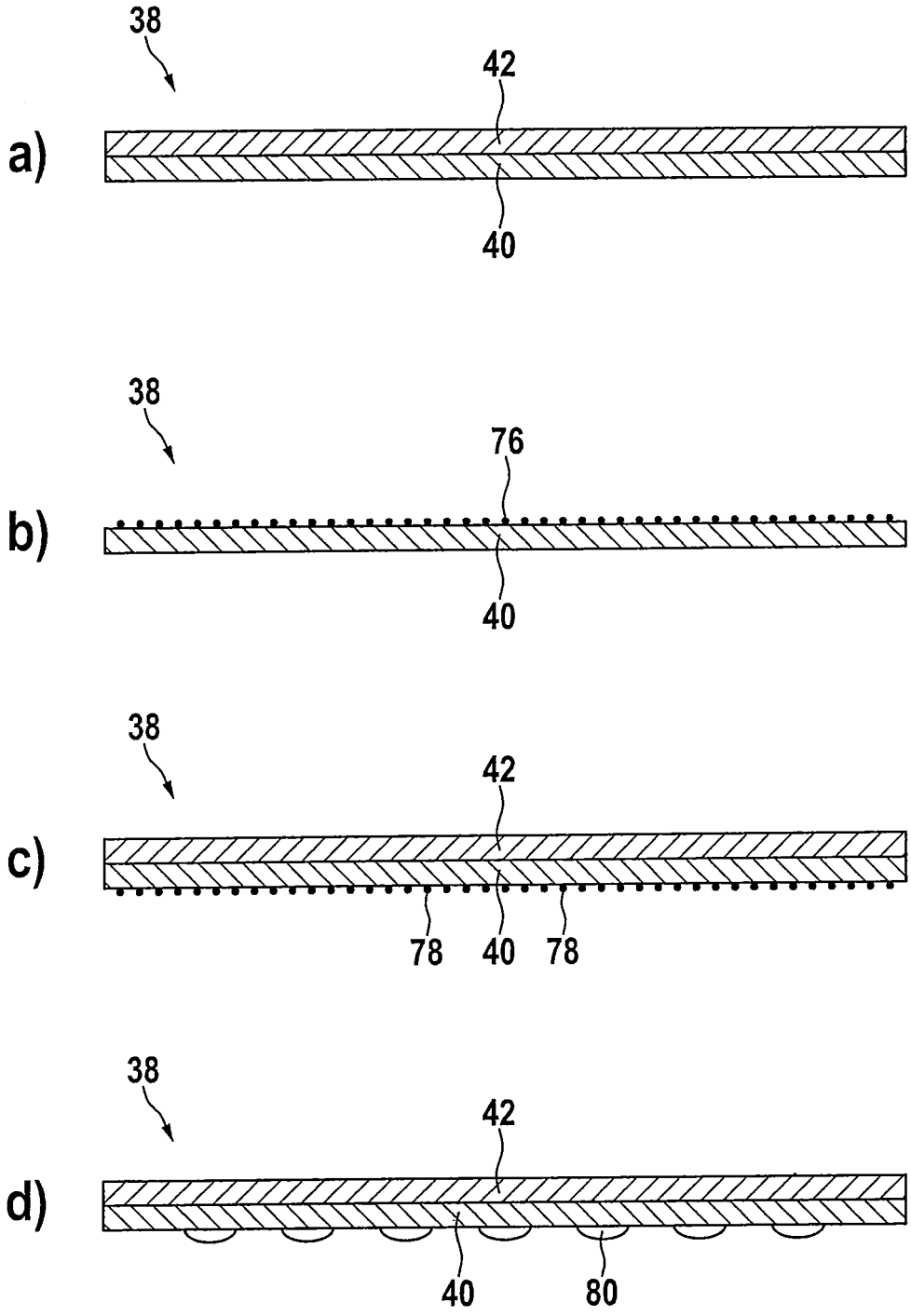
FIG. 8 shows, with the help of four sub-figures FIG. 8(*a*), FIG. 8(*b*), FIG. 8(*c*) and FIG. 8(*d*), four alternative exemplary embodiments for the bottom functional layer laminate of the shoes of the FIGS. 1 to 7, in cross-section.

FIG. 8 shows, with the help of four sub-figures FIG. 8(*a*), FIG. 8(*b*), FIG. 8(*c*) and FIG. 8(*d*) four alternative exemplary embodiments for the bottom functional layer laminate 38, in cross-section.

All bottom functional layer laminates 38 in accordance with FIGS. 1 to 7 may be designed in such a way as shown in the FIGS. 8(*a*)-(*d*).

According to FIG. 8(*a*), the bottom functional layer laminate 38 comprises an upper supporting textile layer 42 and a lower waterproof and breathable bottom functional layer 40, positioned therebelow. The supporting textile layer 42 comprises a textile structure: knit, woven, warp-knit, felt or mixtures thereof.

In accordance with FIG. 8(*b*), the bottom functional layer laminate 38 comprises an upper very permeable supporting textile layer 76, for example from meshed material, and a waterproof and breathable functional layer 40 positioned therebelow. The upper supporting textile layer 76 comprises a smaller height than the supporting textile layer 42 of FIG. 8(*a*) and also has greater openings than the supporting textile layer 42. In this way, the bottom functional layer laminate 38 in accordance with FIG. 8(*b*) allows for an even more increased water vapor transport from the inside to the outside. Moreover, the bottom functional layer 40 may be sealed with respect to a further functional layer through the open structure of the supporting textile layer 76 via sealing glue.

FIG. 8(*c*) shows a bottom functional layer 38 with a supporting textile layer 42 positioned uppermost and a bottom functional layer 40 positioned bottommost, which bottom functional layer 40 is provided at its underside with a plurality of small, discretely distributed dots. These dots prevent an abutting of the bottom functional layer 40 directly with the upper side of the sole unit. In contrast, the dots 78 provide for a distance between the underside of the bottom functional layer 40 and the upper side of the sole unit and thus for an additional protection of the bottom functional layer 40 against undesired damaging and abrasion, without compromising the advantageous increased breathability of the functional layer 40.

The bottom functional layer laminate 38 in accordance with FIG. 8(*d*) is provided with an upper breathable textile layer 42 and a bottom functional layer 40 positioned bottommost, which bottom functional layer 40 is provided at its underside with dots 80 that are larger in area and are broader. These dots 80 prevent an abutting of the bottom functional layer 40 directly with the upper side of the sole unit. In contrast, the dots 80 provide for a distance between the underside of the bottom functional layer 40 and the upper side of the sole unit and thus for an additional protection of the bottom functional layer 40 against undesired damaging.

LIST OF REFERENCE NUMERALS

2 first shoe
4 sole unit
6 injected sole
8 outer surface or tread surface
10 supporting sole
12 water permeable layer
13 vertical openings
14 décor layer
15 netband
16 seam
17 second shoe
18 openings
19 third shoe
20 fourth shoe
22 upper assembly
23 upper portion
24 breathable upper material layer
26 upper functional layer laminate
28 netband/a mesh
30 upper functional layer/upper membrane
32 upper lining
34 multiple layer bottom portion
36 assembly sole/insole
40 lower bottom functional layer
42 upper supporting textile layer/breathable textile layer
44 lasting glue
46 seam
48 sealing glue
50 sole glue layer
54 sole unit
56 sole layer
58 supporting bar layer
60 vertical openings
62 outer surface/tread surface
64 barrier layer
66 décor layer
68 sole glue layer
70 fifth shoe
72 lateral openings
74 sixth shoe
75 glue connection
76 mesh-like upper supporting textile layer
78 small dots
80 big dots

What is claimed is:

1. Upper assembly for footwear, the upper assembly comprising an upper portion with a breathable upper material layer, having a lower end area, and with a waterproof and breathable upper functional layer laminate, having a lower end area; and a bottom portion with a bottom functional layer laminate, having a side end area;

wherein the lower end area of the upper portion is connected to the side end area of the bottom portion; and wherein the bottom functional layer laminate is a multiple layer laminate, which comprises a waterproof and breathable functional layer positioned bottommost and at least a breathable textile layer positioned thereabove.

2. Upper assembly according to claim 1, wherein the multiple layer bottom functional layer laminate is a two layer laminate.

3. Upper assembly according to claim 1, wherein the upper functional layer laminate is a three layer laminate.

4. Upper assembly according to claim 1, wherein the lower end area of the upper portion is designed such that it allows for a penetration of sealing material to the waterproof and breathable functional layer of the functional layer laminate of the upper portion.

5. Upper assembly according to claim 1, wherein a netband is provided, which connects the lower end area of the breathable upper material layer with the side end area of the bottom functional layer laminate, wherein the netband is penetrable for injected sole material to the waterproof and breathable functional layer of the functional layer laminate of the upper portion and of the bottom portion.

6. Upper assembly according to claim 1, wherein the lower end area of the functional layer laminate of the upper portion is sewn to the side end area of the bottom functional layer laminate, in particular with a strobel or zigzag seam.

7. Upper assembly according to claim 1, wherein the bottom portion functional layer is provided with supporting members at its underside.

8. Footwear, comprising at least an upper assembly according to claim 1 and a sole unit that is provided with at least one passage opening or that is porous, wherein at least a part of the sole unit is attached to the underside of the upper assembly, and wherein the side end area of the bottom functional layer laminate and the lower end area of the functional layer laminate of the upper portion are bonded together, wherein a waterproof seal is provided at the bond.

9. Footwear according to claim 8, wherein at least a part of the sole unit is injected on the underside of the upper assembly.

10. Footwear according to claim 8, wherein at least a part of the sole unit is glued to the underside of the upper assembly.

11. Footwear according to claim 8, wherein at least a part of the sole unit is sewn to the underside of the upper assembly.

12. Footwear according to claim 8, wherein at least one passage opening leading to the underside of the sole unit is provided in the sole unit.

13. Footwear according to claim 8, wherein at least one passage opening leading to the side of the sole unit is provided in the sole unit.

14. Footwear according to claim 8, wherein the sole unit comprises porous, in particular breathable material.

* * * * *